US011805966B1

(12) United States Patent
Valdes et al.

(10) Patent No.: US 11,805,966 B1
(45) Date of Patent: Nov. 7, 2023

(54) FOOTWEAR DRYING DEVICE AND METHODS OF MAKING AND USING THE SAME

(71) Applicants: Carlos Valdes, Raleigh, NC (US); Emily Valdes, Raleigh, NC (US); Iris Valdes, Raleigh, NC (US)

(72) Inventors: Carlos Valdes, Raleigh, NC (US); Emily Valdes, Raleigh, NC (US); Iris Valdes, Raleigh, NC (US)

( * ) Notice: Subject to any disclaimer, the term of this patent is extended or adjusted under 35 U.S.C. 154(b) by 0 days.

(21) Appl. No.: 17/882,408

(22) Filed: Aug. 5, 2022

(51) Int. Cl.
*A47L 23/20* (2006.01)

(52) U.S. Cl.
CPC ..... *A47L 23/205* (2013.01)

(58) Field of Classification Search
CPC ..... A47L 23/205
USPC ..... 34/106
See application file for complete search history.

(56) References Cited

U.S. PATENT DOCUMENTS 2,942,344 A * 6/1960 Brannock ..... A43D 1/027 33/3 B
4,702,016 A * 10/1987 Grigsby ..... D06F 58/04 34/106
5,024,408 A * 6/1991 Magee ..... D06F 58/04 248/316.4
5,080,312 A * 1/1992 Ebey ..... D06F 58/04 248/200.1
5,623,769 A * 4/1997 Hayden ..... D06F 58/04 34/106
5,822,223 A * 10/1998 Genest ..... A43D 1/02 702/170
6,134,810 A * 10/2000 Stockley ..... D06F 35/006 68/189
8,914,991 B2 * 12/2014 Jackson ..... D06F 58/04 34/600
9,635,998 B2 * 5/2017 Dowell ..... A47L 23/20
11,439,293 B2 * 9/2022 Taylor ..... F16B 2/12
11,486,085 B2 * 11/2022 Erickson ..... D06F 58/20
2016/0076191 A1 * 3/2016 Warren ..... D06F 58/04 34/239
2022/0354340 A1 * 11/2022 Kim ..... A47L 23/205

FOREIGN PATENT DOCUMENTS

CN 110067120 A * 7/2019 ..... A47L 23/205
FR 2860700 A1 * 4/2005 ..... A43D 1/02

* cited by examiner

*Primary Examiner* — Stephen M Gravini
(74) *Attorney, Agent, or Firm* — Ashley D. Johnson; Dogwood Patent and Trademark Law

(57) ABSTRACT

The invention is directed to a drying device comprising a base with a pair of arms adjustably attached to each side of the base. The arms are angled inward relative to the base, allowing them to adapt to a wide variety of footwear. The underside of each base includes one or more magnets that removably attach the device to a conventional dryer. Each base includes one or more apertures that promote air flow when the device is in use. In use, the footwear remains compressed on the walls of the drying device via the magnets. After the drying cycle has been completed, the footwear is dried on the exterior and interior surface.

20 Claims, 6 Drawing Sheets

FOOTWEAR DRYING DEVICE AND METHODS OF MAKING AND USING THE SAME

TECHNICAL FIELD

The presently disclosed subject matter relates generally to a footwear drying device that can be used in a conventional dryer. The disclosed subject matter also includes methods of making and using the disclosed device.

BACKGROUND

Various types of drying devices are known in the art, For example, clothes dryers are commonly used to dry wet clothing after they have been washed. Automatic clothes dryers typically include a rotating drum operatively connected to a heat source. During drying, heat is introduced into the rotating drum using a fan or a blower to dry the wet items. Footwear is often washed in a conventional washing machine or by hand to remove dirt and stains. However, when footwear is placed into the drum of a conventional dryer, the shoes tumble against the walls of the drum causing a loud and distracting noise, In addition, the force from the tumbling shoes can oftentimes knock open the door to the dryer, leaving the items inside damp or wet. The repetitive tumbling motion can also damage footwear placed in the dryer, When the dryer cycle has finished, footwear often is not fully dry, especially on the interior portion. The footwear must then be air dried, which takes additional time, Alternatively, the footwear can be placed again in the dryer for a longer period of time, which wastes energy and restarts the loud and distracting noise. It would therefore be beneficial to provide a drying device that overcomes the shortcomings of the prior art.

SUMMARY

In some embodiments, the presently disclosed subject matter is directed to a drying device comprising a base. The base is defined by a first base end and an opposed second base end, a top face and an opposed bottom face, a pair of side edges that span from the first base end to the second base end, a first support configured at the first base end, a second support configured at the second base end, and a base aperture positioned between the first and second supports. The device also includes a pair of arms, each arm defined by a lower edge connected to a base side edge, a main body that curves inward towards a midline of the base, an extension positioned at an upper edge of the main body that curves inward from the main body towards a midline of the base to create an interior, wherein each extension comprises an aperture. The device includes at least one magnet positioned on the bottom face of the base, below the first support, second support, or both.

In some embodiments, the base is planar.

In some embodiments, the first and second supports have the same shape as the at least one magnet.

In some embodiments, each magnet comprises a rubber coating.

In some embodiments, the base has a length of about 4-15 inches, a width of about 3-8 inches, and a thickness of about 0.25-2 inches.

In some embodiments, the first support includes a magnet, and the second support includes a magnet, each positioned on the bottom face of the base.

In some embodiments, each extension aperture includes a first angle of about 20-45 degrees and a second angle of about 45-65 degrees.

In some embodiments, the arms have a length of about 6-10 inches, a height of about 1.5-4 inches, and a thickness of about 0.25-2 inches.

In some embodiments, each extension comprises an uppermost edge, such that the distance between the arm uppermost edges is less than the distance between the side edges of the base.

In some embodiments, the base and arms are constructed from rubber, metal, wood, plastic, or combinations thereof.

In some embodiments, the presently disclosed subject matter is directed to a method of drying footwear. The method includes positioning an item of footwear defined by a toe and heel within the interior of the disclosed drying device, wherein the toe of the footwear contacts a top surface of the first support and the heel of the footwear contacts at top face of the second support. The method includes placing the device within an interior of a dryer with an interior drum comprising a wall such that the at least one magnet contacts the interior drum wall. The method includes releasing the device, wherein the at least one magnet allows the device to engage the wall of the drum, thereby retaining the footwear within the interior of the dryer. The method includes initiating the drying cycle of the dryer, whereby the drum spins and the device is retained on the walls of the drum during spinning, whereby the footwear is dried.

In some embodiments, the dryer is a clothes dryer.

In some embodiments, the drying cycle is at least 20 minutes.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1:
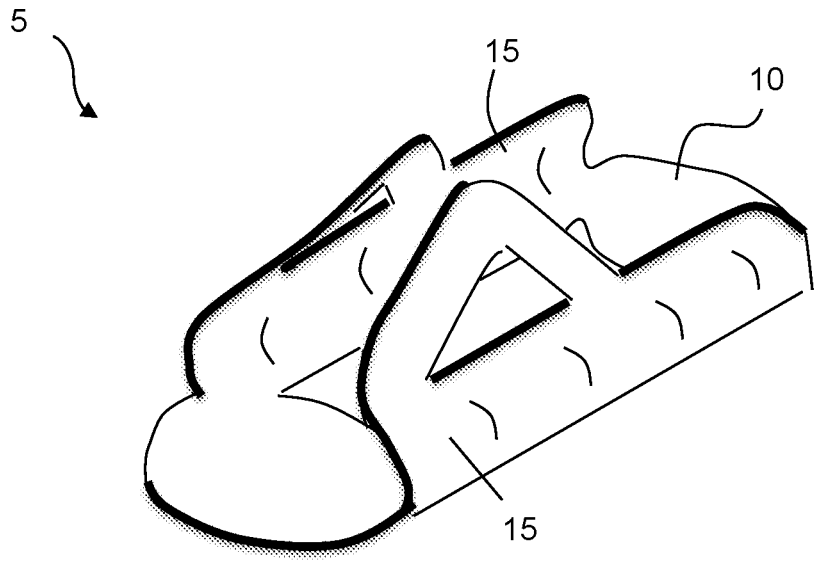
FIG. 1 is a perspective view of a drying device in accordance with some embodiments of the presently disclosed subject matter.

FIG. 1 illustrates one embodiment of drying device 5. As shown, the device comprises base 10 with a pair of arms 15 adjustably attached to each side of the base. The arms are angled relative to the base, allowing them to adapt to a wide variety of footwear. The term "footwear" broadly includes any item of apparel that is worn on the foot of a user, such as (but not limited to) running shoes, boots, shoes, sandals, boat shoes, slippers, hiking shoes, and the like. The underside of each base includes one or more magnets that removable attach the device to a conventional dryer. Each base includes one or more apertures that promote air flow when the device is in use.

Figure 2A:
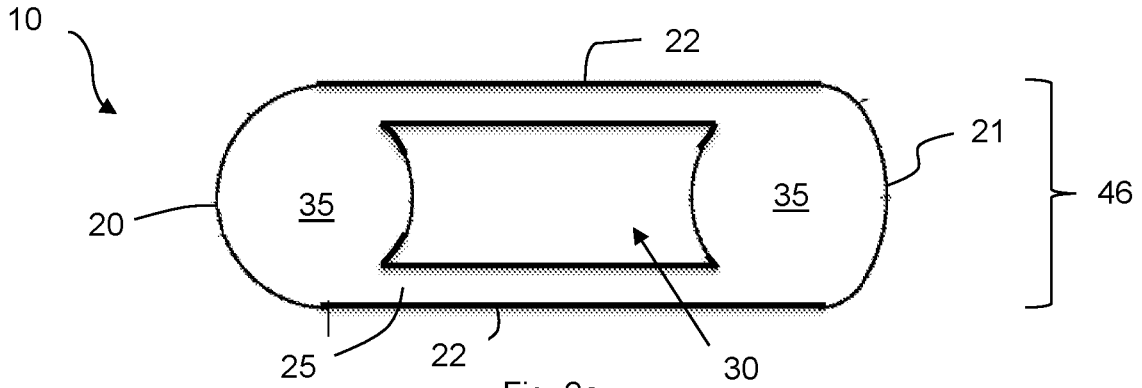
FIG. 2*a* is a top plan view of a device base in accordance with some embodiments of the presently disclosed subject matter.
Figure 2B:
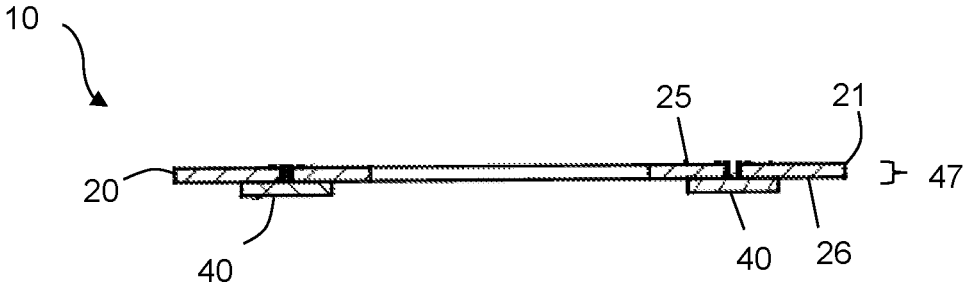
FIG. 2*b* is a side plan view of a device base in accordance with some embodiments of the presently disclosed subject matter.

As set forth above, the disclosed device includes planar base 10 positioned in the lower portion of device 5, acting as a support. The term "planar" refers to a two dimensional element lying primarily on a single plane. One embodiment of base 10 is illustrated in FIGS. 2*a* and 2*b*. As shown, the base includes first end 20 and opposed second end 21 and opposed side edges 22. The base further includes top face 25 and opposed bottom face 26. The top face of the base comes into direct contact with an item of footwear, while the bottom face is adjacent to a support surface (such as the interior of a dryer). The base also includes central aperture 30 positioned between first and second ends 20, 21. The term "aperture" refers to an opening that extends through the thickness of the base. The base can be configured to include rounded supports 35 at each end to provide a surface for supporting the toe and heel of an item of footwear. However, it should be appreciated that support 35 can have any desired shape (e.g., square, rectangular, triangular, abstract).

Figure 2C:
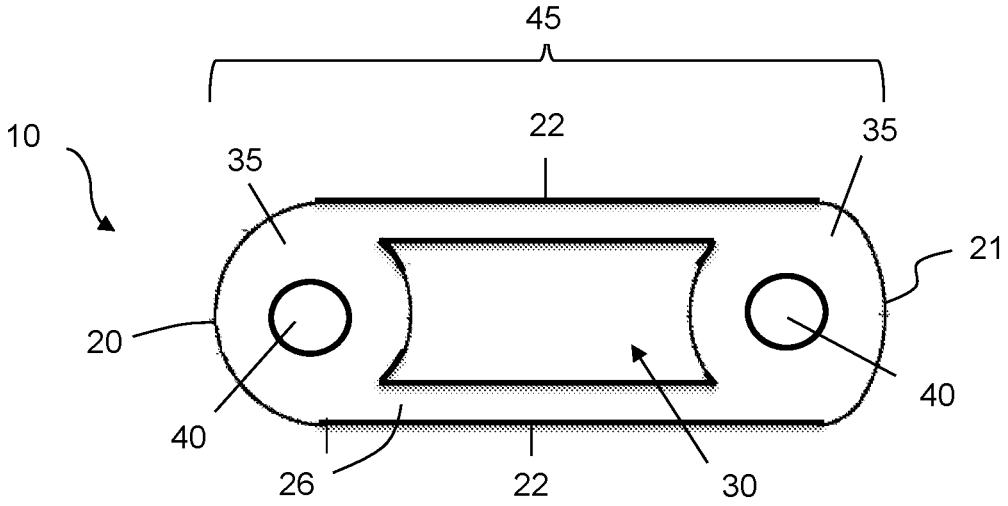
FIG. 2*c* is a bottom plan view of a device base in accordance with some embodiments of the presently disclosed subject matter.
Figure 2D:
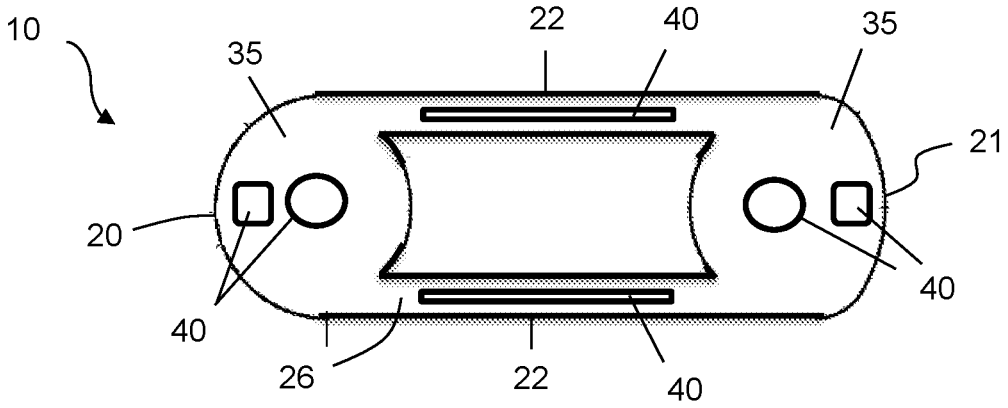
FIG. 2*d* is a bottom plan view of a device base comprising a plurality of magnets in accordance with some embodiments of the presently disclosed subject matter.

As shown in FIGS. 2*b* and 2*c*, bottom face 26 of the base includes a plurality of magnets 40. In some embodiments, one magnet is positioned beneath each support 35 to fully adhere the device to the interior of a dryer without slippage. However, magnets 40 can be positioned on any position of bottom face 26 as shown in FIG. 2*d*. In some embodiments, the magnet and support 35 are configured in the same or about the same shape to ensure that the device is not off-balanced when in use.

The term "magnet" refers to a body that produces a magnetic field external to itself. Suitable magnets can be constructed from iron, steel, or alloys thereof. However, magnet 40 can be produced from any material that can be magnetized (e.g., pulls on other ferromagnetic or magnetic materials and attracts or repels other magnets or iron-comprising objects, or aligning itself in an external magnetic field). The term "magnet" can thus include permanent magnets of an object made from a material that is magnetized and creates its own persistent magnetic field (e.g., iron, nickel, cobalt, some naturally occurring minerals and alloys of rare earth metals). In some embodiments, the magnet(s) can include a coating to protect the interior of the dryer from damage (e.g., a rubber coating).

Magnet 40 can be adhered to bottom face 26 using any suitable mechanism, such as (but not limited to) the use of adhesives, welding, mechanical fasteners (e.g., screws, bolts, clips), or combinations thereof. Thus, in some embodiments, the magnet is permanently attached to base 10, while in other embodiments the magnet can be removably attached or replaced.

The base can have length 45 of about 4-15 inches (e.g., at least/no more than about 4, 5, 6, 7, 8, 9, 10, 11, 12, 13, 14, or 15 inches). The term "length" refers to the dimension in the longitudinal direction of the device, e.g., the distance between first end 20 and second end 21. Base 10 can further include width 46 of about 3-8 inches (e.g., at least/no more than about 3, 4, 5, 6, 7, or 8 inches). The term "width" refers to the distance between side edges 22, as shown. Base 10 further includes thickness 47 of about 0.25-2 inches (e.g., at least/no more than about 0.25, 0.5, 0.75, 1, 1.25, 1.5, 1.75, or 2 inches). The term "thickness" refers to the distance between top and bottom faces 25, 26. It should be appreciated that base 10 is not limited and can be configured with a length, width, and/or thickness outside the ranges given above.

Base 10 can have any desired shape, such as (but not limited to) circular, oval, square, rectangular, triangular, pentagonal, hexagonal, octagonal, and the like. It should be appreciated that any shape can be used.

Figure 3A:
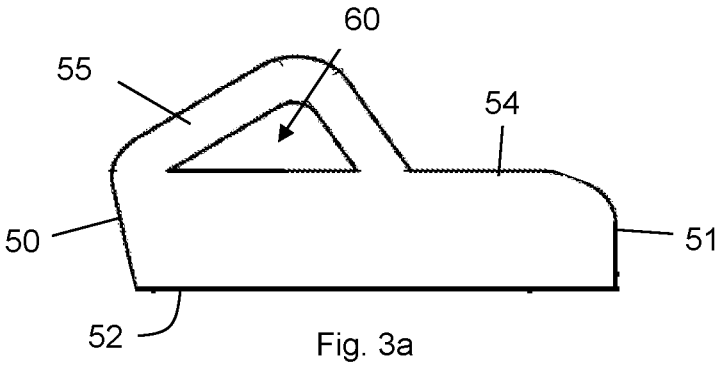
FIG. 3*a* is a side plan view of a device arm in accordance with some embodiments of the presently disclosed subject matter.
Figure 3B:
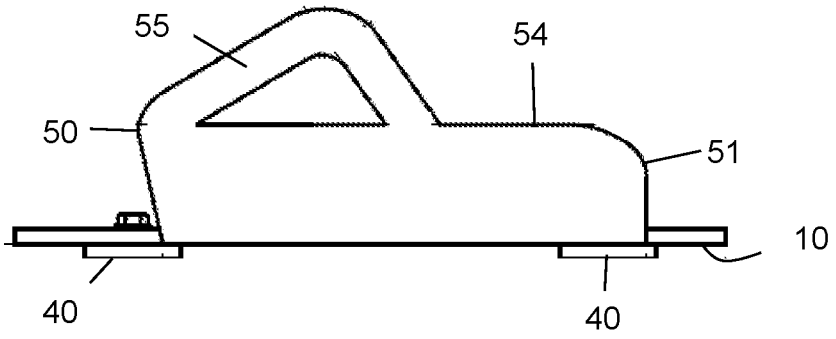
FIG. 3*b* is a side plan view of a device arm attached to a device base in accordance with some embodiments of the presently disclosed subject matter.

As set forth above, device 5 further includes a pair of arms 15 positioned to extend upwards from base side edges 22, as shown in FIGS. 3*a* and 3*b*. Each arm includes first and second ends 50, 51 and a length therebetween. The arms also include lower edge 52 that is operatively connected to base side edges 22 using any suitable mechanism (e.g., welding, thermoforming, adhesive, magnets, fasteners). Top edge 54 of each arm includes extension 55 that continues upward and functions to fold over and contact an upper region of an item of footwear to retain the footwear in the device. Each extension includes aperture 60 that provides air flow during drying and also prevents distortion or damage to the footwear.

In some embodiments, extensions 55 are permanently configured on the top edge of the arms using conventional mechanisms, such as the use of adhesive, welding, and the like. In other embodiments, the extensions are removably attached through the use of snap-fit attachment, pressure fit attachment, magnets, ties, fasteners, screws, and the like.

Figure 3C:
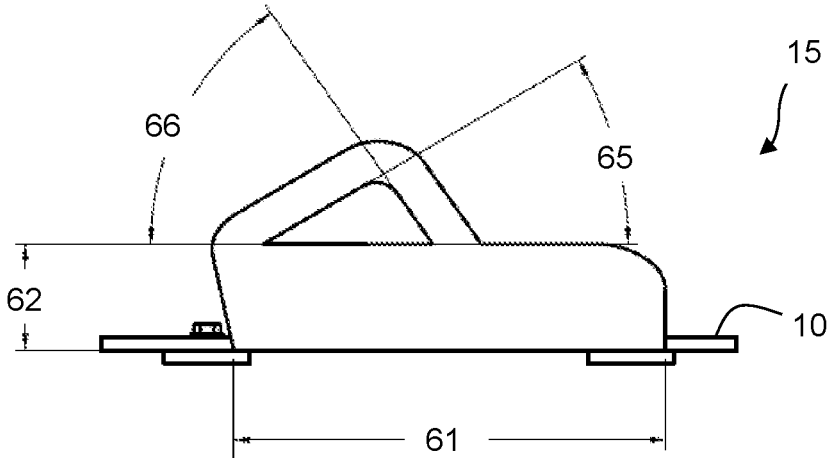
FIG. 3*c* is a side plan view of a device arm attached to a base in accordance with some embodiments of the presently disclosed subject matter.

As shown in FIG. 3*c*, arm 15 can have length 61 of about 6-10 inches in some embodiments. Thus, the arm length can be at least about (or no more than about) 6, 7, 8, 9, or 10 inches. The arm height 62 can further be about 1.5-4 inches (e.g., at least/no more than about 1.5, 2, 2.5, 3, 3.5, or 4 inches). The thickness of each arm can be about 0.25-2 inches (e.g., at least/no more than about 0.25, 0.5, 0.75, 1, 1.25, 1.5, 1.75, or 2 inches). Aperture 60 can include first and second angles 65, 66. First angle 65 can be about 20-45 degrees (e.g., at least/no more than about 20, 25, 30, 35, 40, 45 degrees). Second angle 66 can be about 45-65 degrees (e.g., at least/no more than about 45, 50, 55, 60, or 65 degrees). The angles can be provided to ensure that optimal air flow reaches an included footwear item when the device is in use. It should be appreciated that arm 15 is not limited and can include a length, width, thickness, first angle, and/or second angle outside the ranges given above.

Figure 3D:
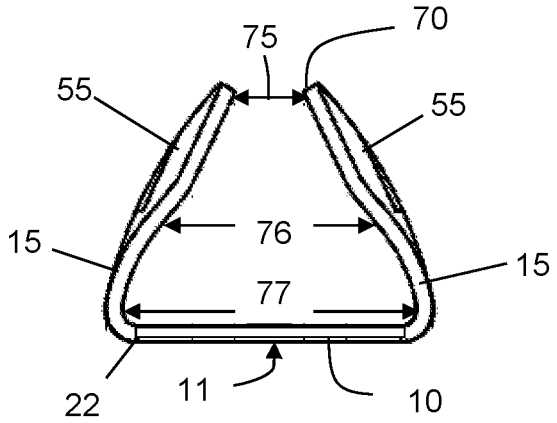
FIG. 3*d* is a front plan view of a pair of device arms attached to a base in accordance with some embodiments of the presently disclosed subject matter.

The arms curve inward towards the midline 11 of the base, as illustrated in FIG. 3*d*. The midline of the base includes a line drawn through the approximate center of the base from the first end to the second end (splitting the base into to equal halves). Thus, distance 75 between upper edges 70 of each extension 55 are less than distance 76 between the lower edges of the extension and distance 77 between the lower edge of the arms. In this way, the arms function to fold around an item of footwear, maintaining the footwear within the device interior during use (e.g., during tumbling in the dryer).

Base 10 and arms 15 can be constructed from any suitable material. Thus, the disclosed device base and arms can be constructed from one or more polymeric materials (e.g., high density polyethylene, polypropylene, etc.), wood, metal (stainless steel, steel, aluminum, platinum, copper, etc.), rubber, or combinations thereof.

The disclosed device can have any desired weight, such as (but not limited to) about 1-15 pounds (e.g., at least about or no more than about 1, 2, 3, 4, 5, 6, 7, 8, 9, 10, 11, 12, 13, 14, or 15 pounds). However, it should be appreciated that device 5 can be constructed to have a weight that is outside the range set forth above.

Device 5 can be constructed using any known method, such as extrusion, injection molding, compression molding, welding, and the like.

Figure 4A:
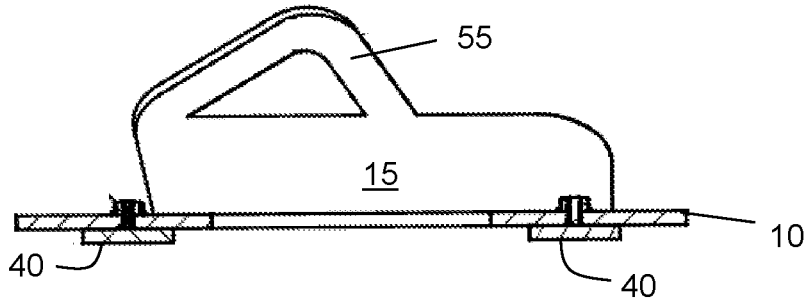
FIG. 4*a* is a side plan view of a device in accordance with some embodiments of the presently disclosed subject matter.
Figure 4B:
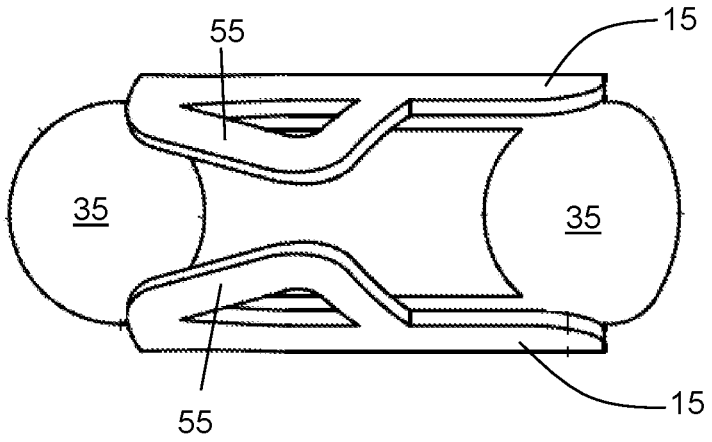
FIG. 4*b* is a top plan view of the device of FIG. 4*a* in accordance with some embodiments of the presently disclosed subject matter.
Figure 4C:
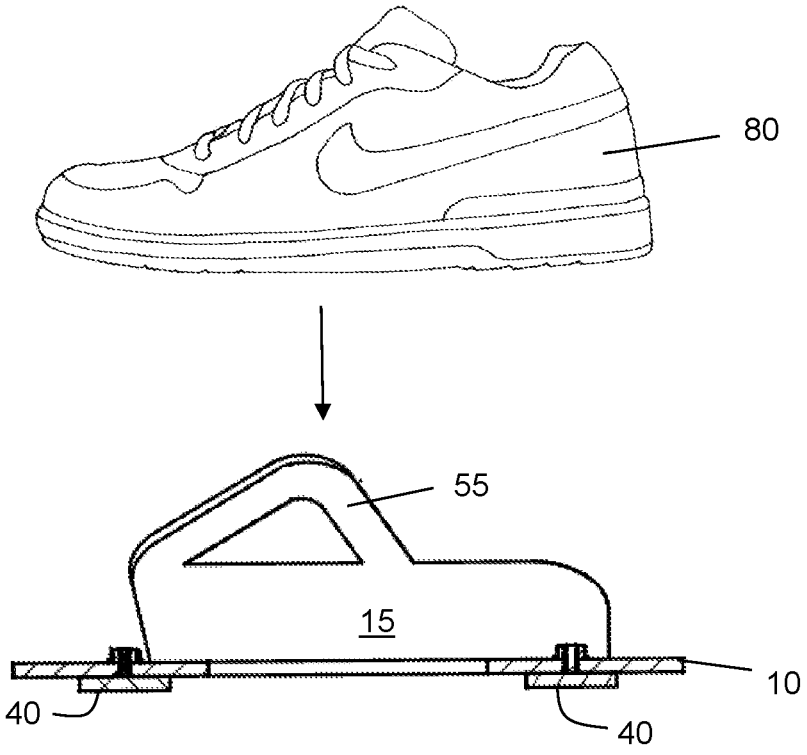
FIG. 4*c* illustrates a method of inserting an item of footwear in a drying device in accordance with some embodiments of the presently disclosed subject matter.
Figure 4D:
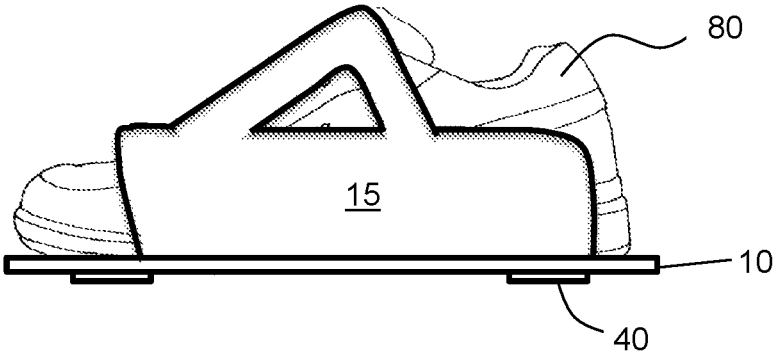
FIG. 4*d* is a side plan view of a device with an inserted item of footwear in accordance with some embodiments of the presently disclosed subject matter.

In use, the disclosed device can be assembled by assembling arms 15 on each side edge of the base using conventional methods. In some embodiments, the device comes pre-assembled with an arm attached to each side edge of the base, as shown in FIGS. 4*a* and 4*b*. A user can insert one shoe 80 within the interior of the device such that the bottom face of the shoe toe and heel directly contacts supports 35 and the body of the shoe fits in between and under the device arms and extension, as illustrated in FIGS. 4*c* and 4*d*. The arms and extensions can be somewhat flexible, allowing them to move inward and outward to allow a shoe to fit into the device interior region. The process can optionally be repeated with the other shoe.

With the shoe in place, device 5 can be placed int the drum of a drying device. Magnets 40 keep the device in place and from moving around the dryer interior. Specifically, the magnets attract to the interior of the dryer (which is metal). When the device is released in the drum, the attraction exerted by magnets 40 on the drum maintain the device in a set position on the drum interior. The device and shoe are held in position due to the attraction force between the magnet and the drum interior. The dryer can then be activated and as the drum turns, so does device 5 and the shoe is fully dried at the end of the dry cycle. The shoe is held in place despite the rotation of the drum and the movement of other items (e.g., clothing) that may be present in the drum. In some embodiment, multiple devices can be used simultaneously while the dryer is in use (e.g., a pair of shoes or multiple pairs of shoes).

As the drum rotates, the device moves through a circular path having a diameter that is about the same as the drum. Centrifugal force acts on the air molecules in the device near the device apertures.

It should be appreciated that device 5 can be used in a range of drum sizes of different brands and models of drying devices.

When the drying cycle is complete, the user can apply a pressure to dislodge magnets 40 from the dryer interior. In doing so, the device is no longer retained adjacent to the dryer drum. The user can then remove the device, remove the shoe from the interior of the device, and wear the dried footwear.

The disclosed device offers many advantages over the prior art. For example, the small footprint of the disclosed device allows for one pair or multiple pairs of shoes to be dried simultaneously.

The unique aperture configuration in the device promotes efficient drying of footwear. Specifically, the apertures facilitate convection air to flow through the interior of the footwear, thereby drying the item more evenly on the interior and exterior.

The disclosed device is easy to use, such that even children and the elderly can effectively install and use the device.

Device 5 is resilient, allowing the user to enjoy the device for many years without breaking or requiring replacement.

The disclosed device is universal and can be used in drums of most (if not all) drying devices and can further accommodate footwear of different sizes and types.

The device can further dry footwear without incurring a loud and distracting noise form the shoes tumbling on the drum interior.

The disclosed device protects footwear, keeping them from banging around and becoming damaged during drying.

Further, the disclosed device can be economically produced, allowing for most consumers to be able to afford and use the device.

These and other advantages would be apparent to those of ordinary skill in the art after a review of the presently disclosed subject matter.

What is claimed is:

1. A drying device comprising:

a base defined by:

a first base end and an opposed second base end;

a top face and an opposed bottom face;

a pair of side edges that span from the first base end to the second base end;

a first support configured at the first base end;

a second support configured at the second base end;

a distance between the first support and the second support;

a base aperture spanning the distance between the first support and the second support;

a pair of arms, each arm defined by:

a lower edge connected to a base side edge, wherein each lower edge spans the distance from the first support to the second support;

a main body that curves inward towards a midline of the base;

an extension positioned at an upper edge of the main body that curves inward from the main body towards a midline of the base to create an interior, wherein each extension comprises an aperture;

at least one magnet positioned on the bottom face of the base, below the first support, second support, or both.

2. The device of claim 1, wherein the base is planar.

3. The device of claim 1, wherein the first and second supports are configured in a shape that is the same as a shape of the at least one magnet.

4. The device of claim 1, wherein each magnet comprises a rubber coating.

5. The device of claim 1, wherein the base has a length of about 4-15 inches, a width of about 3-8 inches, and a thickness of about 0.25-2 inches.

6. The device of claim 1, wherein the first support includes a magnet and the second support includes a magnet, each positioned on the bottom face of the base.

7. The device of claim 1, wherein each extension aperture includes a first angle of about 20-45 degrees and a second angle of about 45-65 degrees.

8. The device of claim 1, wherein the arms have a length of about 6-10 inches, a height of about 1.5-4 inches, and a thickness of about 0.25-2 inches.

9. The device of claim 1, wherein each extension comprises an uppermost edge, such that a distance between each uppermost edge is less than a distance between the side edges of the base.

10. The device of claim 1, wherein the base and arms are constructed from rubber, metal, wood, plastic, or combinations thereof.

11. A method of drying footwear, the method comprising:

positioning an item of footwear defined by a toe and heel within an interior of a drying device comprising:

a base defined by:

a first base end and an opposed second base end;

a top face and an opposed bottom face;

a pair of side edges that span from the first base end to the second base end;

a first support configured at the first base end;

a second support configured at the second base end;

a distance between the first support and the second support;

a base aperture spanning the distance between the first support and the second support;

a pair of arms, each arm defined by:

a lower edge connected to a base side edge, wherein each lower edge spans the distance from the first support to the second support;

a main body that curves inward towards a midline of the base;

an extension positioned at an upper edge of the main body that curves inward from the main body towards a midline of the base to create an interior, wherein each extension comprises an aperture;

at least one magnet positioned on the bottom face of the base, below the first support, second support, or both;

wherein the toe contacts a top surface of the first support and the heel contacts at top face of the second support;

placing the device within an interior of a dryer with an interior drum comprising a wall such that the at least one magnet contacts the wall of the interior drum;

releasing the device, wherein the at least one magnet allows the device to engage the wall of the drum, thereby retaining the footwear within the interior of the dryer;

initiating a drying cycle of the dryer, whereby the drum spins and the device is retained on the walls of the drum during spinning;

whereby the footwear is dried.

12. The method of claim 11, wherein the dryer is a clothes dryer.

13. The method of claim 11, wherein the drying cycle is at least 20 minutes.

14. The method of claim 1, wherein the first and second supports have the same shape as the at least one magnet.

15. The method of claim 11, wherein each magnet comprises a rubber coating.

16. The method of claim 11, wherein the base has a length of about 4-15 inches, a width of about 3-8 inches, and a thickness of about 0.25-2 inches.

17. The method of claim 11, wherein the first support includes a magnet and the second support includes a magnet, each positioned on the bottom face of the base.

18. The method of claim 11, wherein each extension aperture includes a first angle of about 20-45 degrees and a second angle of about 45-65 degrees.

19. The method of claim 11, wherein the arms have a length of about 6-10 inches, a height of about 1.5-4 inches, and a thickness of about 0.25-2 inches.

20. The method of claim 11, wherein each extension comprises an uppermost edge, such that a distance between the arm uppermost edges is less than the distance between the side edges of the base.

* * * * *